US009823052B2

(12) United States Patent
Nieuwoudt

(10) Patent No.: US 9,823,052 B2
(45) Date of Patent: Nov. 21, 2017

(54) SELF-STEMMING CARTRIDGE

(71) Applicant: Fowlds 3 Limited, Tortula (VG)

(72) Inventor: Gerhard Nieuwoudt, Cape Town (ZA)

(73) Assignee: Fowlds 3 Limited, Tortola (VG)

( * ) Notice: Subject to any disclaimer, the term of this patent is extended or adjusted under 35 U.S.C. 154(b) by 0 days.

(21) Appl. No.: 15/033,823

(22) PCT Filed: Nov. 5, 2014

(86) PCT No.: PCT/IB2014/065817

§ 371 (c)(1),
(2) Date: May 2, 2016

(87) PCT Pub. No.: WO2015/068110

PCT Pub. Date: May 14, 2015

(65) Prior Publication Data

US 2016/0282091 A1 Sep. 29, 2016

(30) Foreign Application Priority Data

Nov. 5, 2013 (ZA) ..... 2013/08286

(51) Int. Cl.
*F42D 1/00* (2006.01)
*F42B 3/087* (2006.01)
*F42D 3/04* (2006.01)

(52) U.S. Cl.
CPC ..... *F42B 3/087* (2013.01); *F42D 3/04* (2013.01)

(58) Field of Classification Search
CPC .... F42B 3/087; F42B 3/00; F42B 3/24; F42D 1/20; F42D 1/22
USPC ..... 102/304, 313, 314, 322, 323
See application file for complete search history.

(56) References Cited

U.S. PATENT DOCUMENTS 1,832,132 A * 11/1931 Lanier, Jr. ..... F42D 1/08 102/304
2,007,568 A * 7/1935 Heitzman ..... F42D 1/18 102/333
2,296,504 A * 9/1942 Crater ..... F42D 1/18 102/333
2,388,232 A 10/1945 Farrell
3,952,656 A * 4/1976 Fox ..... E21D 9/006 102/304
3,978,793 A * 9/1976 McLennan ..... F42B 5/105 102/432

(Continued)

FOREIGN PATENT DOCUMENTS

DE 3321357 A1 12/1984
EP 2474806 A2 7/2012
WO 2013/150462 A1 10/2013

*Primary Examiner* — Michael David
(74) *Attorney, Agent, or Firm* — Cesari and McKenna, LLP

(57) ABSTRACT

A cartridge (1) is provided which includes an elongate tube (3) having a central body (5) that is closed at each end (11, 13) and containing a gas producing substance (30) therein. The tube (3) is made from a plastics material that is capable of outward deformation and a band (15) of an elastically deformable material is provided about the tube (3) adjacent each closed end. The tube (3) is configured such that internal pressure in the tube (3) caused by initiation of the gas producing substance (30) results in outward deformation of the body (5) and each band (15) and subsequent rupture of the body (5) prior to the closed ends being ruptured or opened.

13 Claims, 7 Drawing Sheets

(56) References Cited

U.S. PATENT DOCUMENTS

| | | | | | |
|---|---|---|---|---|---|
| 4,214,532 | A * | 7/1980 | Oulsnam | F42D 1/24 | 102/333 |
| 4,754,705 | A * | 7/1988 | Worsey | F42D 1/08 | 102/312 |
| 5,247,886 | A * | 9/1993 | Worsey | F42D 1/18 | 102/312 |
| 5,765,923 | A * | 6/1998 | Watson | F42B 3/00 | 102/313 |
| 6,035,784 | A * | 3/2000 | Watson | E21B 43/117 | 102/312 |
| 6,062,143 | A * | 5/2000 | Grace | C06D 5/06 | 102/530 |
| 6,339,992 | B1 * | 1/2002 | Watson | E21C 37/12 | 102/302 |
| 6,386,111 | B1 * | 5/2002 | Shann | F42D 1/08 | 102/312 |
| 8,342,095 | B2 * | 1/2013 | Bassett | F42B 3/087 | 102/304 |
| 8,955,606 | B2 * | 2/2015 | O'Malley | E21B 43/105 | 166/101 |
| 2006/0096487 | A1 * | 5/2006 | Van Dyk | E21C 37/14 | 102/332 |
| 2008/0047455 | A1 * | 2/2008 | Tota | F42D 3/04 | 102/304 |
| 2015/0053106 | A1 * | 2/2015 | Godsiff | F42B 3/087 | 102/323 |

* cited by examiner

SELF-STEMMING CARTRIDGE

CROSS-REFERENCE(S) TO RELATED APPLICATIONS

This application is the National Stage of International Application No. PCT/IB2014/065817, filed on Nov. 5, 2014, which claims priority from South African provisional patent application number 2013/08286, filed on Nov. 5, 2013. The contents of both applications are hereby incorporated by reference in their entirety.

FIELD OF THE INVENTION

This invention relates to rock breaking and more specifically to cartridges used for breaking rock.

The term "rock" as used herein covers natural rock and also includes concrete and similar structures that are to be broken up.

BACKGROUND TO THE INVENTION

Traditional methods of blasting or breaking rock in quarries and mines make use of high energy explosives, often referred to as detonating explosives. High energy explosives crush and pulverise the rock which can then be removed for either retrieving a sought after mineral within the rock or for disposal of the rock or both.

The problem with detonating explosives is that the ignition of the explosive is followed by a violent shockwave which may cause rock fragments to be projected from the explosion site. The projected rock fragments pose a great risk to mine workers, thus commonly requiring a large area surrounding the blasting site to be cleared. Furthermore, the pulverisation of the rock may create a dense cloud of dust surrounding the blasting site, making it impossible to work at the site for extended periods of time.

The problems associated with traditional methods of blasting or breaking rock resulted in the development of rock breaking explosives commonly referred to as non-detonating explosives. Non-detonating explosives function by containing and directing rapidly expanding gases within and against the rock, thereby causing the rock to break without a violent shock wave and pulverisation of the rock.

Non-detonating explosives are used by drilling boreholes into the rock, inserting non-detonating explosive cartridges containing a gas generating compound, commonly a propellant, into the boreholes and igniting the cartridges. Prior to ignition of the cartridge, the borehole must be stemmed commonly by packing particulate material, usually sand, into the borehole after insertion of the cartridge. The packed particulate material keeps the gases created by the cartridge within the borehole once the cartridge has been ignited resulting in high pressure being created within the borehole.

A drawback of non-detonating explosives is that adequate stemming of the borehole is of utmost importance, failure of which may cause some of the gas to escape thereby reducing the pressure exerted on the rock and causing the cartridge to be less effective. Furthermore, stemming of boreholes that run at a downward slope may be difficult thus often being very time consuming to achieve. Also, stemming material needs to be transported to the blasting site.

A self-stemming cartridge is proposed in U.S. Pat. No. 8,342,095. One embodiment of the cartridge disclosed in the patent has a sheath which is tapered radially inwardly at one end and which houses a gas generating compound and a cone. The patent discloses that the cone is forced in the direction of the taper upon ignition of the gas generating compound and forces the sheath outwardly, thereby stemming the borehole.

Drawbacks of the disclosed cartridge include the cartridge having a plug at one end which will be ejected from the cartridge prior to stemming, thus causing the stemming operation to stop and the cartridge to be ejected from the borehole without breaking any of the rock.

Furthermore, the sheath is of a solid construction. This will permit gas to escape about the periphery of the cone when the sheath flexes outwardly after ignition and from the gas pressure within the cartridge. It is thus highly unlikely that the cone will operate to expand the sheath. Also, such flexing will cause the development of empty pockets within the sheath into which the gas can move, thus causing a drop in pressure within the cartridge and resulting in a cessation of combustion of the gas generating compound.

A further disadvantage of the cartridge disclosed in U.S. Pat. No. 8,342,095 is that the sheath is a solid tube and thus unlikely to expand sufficiently to stem the hole. Also, the detonator cord runs between cone and sheath creating a gap which will permit gas to escape and thus prevent proper working of the cartridge during manufacture and handling. The gap will also permit the propellant to leak out of the cartridge. Furthermore, the detonator must be inserted into the cartridge before it can be filled with propellant. This will create an inherently dangerous situation during assembly as there is a possibility of the detonator igniting the propellant during assembly.

There is no evidence of the cartridges proposed by U.S. Pat. No. 8,342,095 being commercially available and the applicant believes this to be a result of these not being capable of functioning for the reasons given above.

WO 2013/150462 discloses a self-stemming cartridge which includes a piston movable relative to a static member under pressure of gas generated in a cartridge to cause expansion of the static member and stemming of the borehole. This cartridge is effective yet requires moving parts to operate.

In this specification, "propellant" shall have its widest meaning and include any suitable gas producing material, and "igniter" shall mean any device capable of causing the propellant to produce gas.

SUMMARY OF THE INVENTION

In accordance with a first aspect of the invention there is provided a cartridge which includes an elongate tube having a central body closed at each end and containing a gas producing substance, the cartridge being characterised in that the tube is made of a plastics material capable of outward deformation, with a band of an elastically deformable material provided about the tube adjacent an end that is to be stemmed and configured so that, in use, internal pressure in the tube caused by initiation of the gas producing substance results in outward deformation of the body and the band being effectively urged into sealing contact with a surrounding wall of a borehole to stem the borehole prior to any subsequent rupture of the elongate tube or dislodgment of any closure from the tube.

Further features of the invention provide for a band of elastically deformable material to be provided about the tube adjacent each end thereof; and for one or both ends of the elongate tube to be provided with a separately manufactured closure.

Further features of the invention provide for the tube to have an inwardly tapered shoulder spaced apart from any closure such that the body, band and any closure attached to an end of the elongate tube have substantially the same diameter; for the or each band to be 15 mm to 40 mm wide and about 2 mm to 5 mm thick; for the body to have a wall thickness of between 1 mm and 3 mm; and for the ends of the tube to have a wall thickness of about double that of the body.

Yet further features of the invention provide for the or each closure to remain secured to the tube at pressures greater than 10 MPa, preferably up to about 40 MPa; and for the end wall of the or each closure to be about 3 mm to 5 mm thick.

Still further features of the invention provide for the or each closure to be fastened to the tube by means of a screw thread arrangement; and for the tube to include a detent so as to prevent removal of the or each closure from the tube once secured thereto.

Further features provide for an initiator to be held within the cartridge; for the initiator to include an elongate nozzle; for the elongate nozzle to be in a press fit to the or one of the closures so as to extend axially therefrom; for the nozzle to be filled with an easily combustible material; and for the free end of the nozzle to be closed by means of a hingedly secured lid and the other end to be closed by means of a frangible membrane.

Yet further features provide for a fuse head to be external to the cartridge; for the fuse head to be held within a spigot which is attachable to the cartridge by means of a screw thread arrangement; for an operating cable to extend externally from the spigot; and for the spigot to include a detent so as to prevent removal thereof from the cartridge once secured.

In accordance with a second aspect of the invention there is provided a booster cartridge substantially similar to the cartridge described above.

Further features provide for the booster cartridge to be securable to a cartridge which has a closure at each end by means of a connector; and for the connector to be configured to allow a flash to run therethrough when the cartridge is initiated so as to initiate the booster cartridge.

BRIEF DESCRIPTION OF THE DRAWINGS

The invention will now be described, by way of example only with reference to the accompanying drawings in which.

DETAILED DESCRIPTION WITH REFERENCE TO THE DRAWINGS

Figure 1:
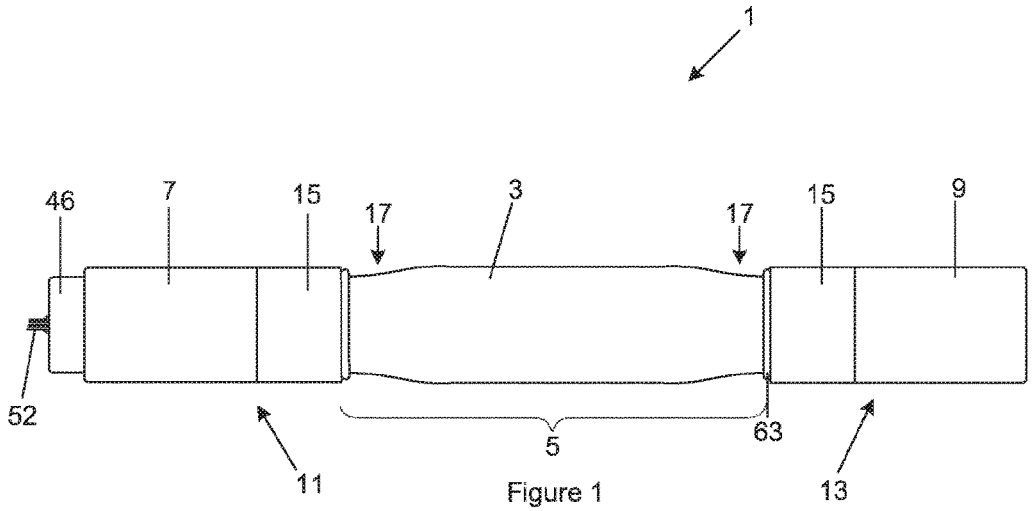
FIG. 1 is a side elevation of a first embodiment of cartridge in accordance with the invention, in which the cartridge has a band and closure at each end.
Figure 2:
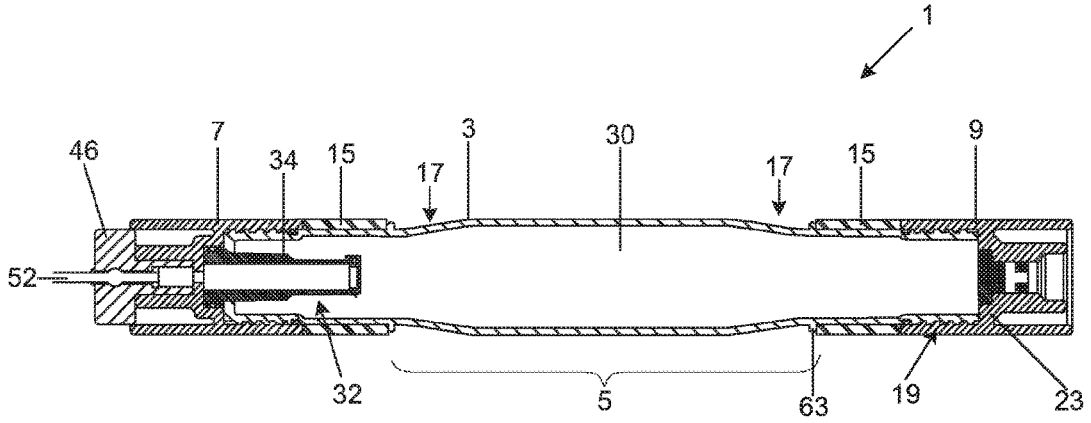
FIG. 2 is a longitudinal section of the cartridge illustrated in FIG. 1.

A first embodiment of cartridge (1) and various components thereof is shown in FIGS. 1 to 10 and includes an elongate tube (3) having a central body (5) with closures (7, 9) at each end (11, 13) thereof. A band (15) of an elastic material is provided about the tube (3) adjacent each closure (7, 9). In this embodiment, the tube (3) has a radiused, inwardly tapered shoulder (17) spaced apart from each end (11, 13) such that the ends have a smaller diameter than the central body (5). This permits the cartridge (1) to have a substantially uniform diameter along its entire length.

Figure 5A:
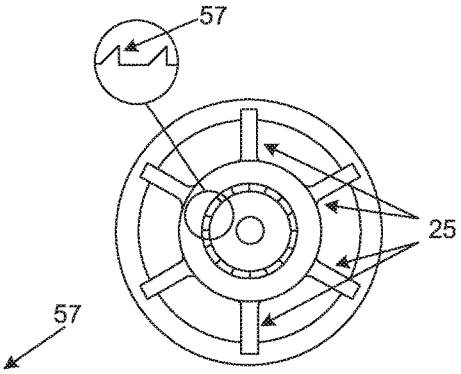
FIGS. 5A and 5B are end views of the closures at each of the two ends of the cartridge illustrated in FIGS. 1 to 3.
Figure 5B:
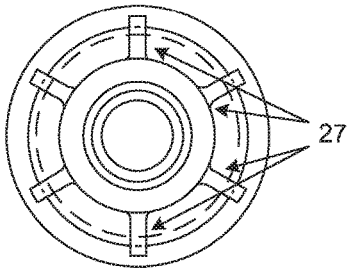

The tube (3) is made, in this embodiment, from low density polyethylene (LDPE) which is selected to permit outward deformation of the tube (3). However, high density polyethylene (HDPE), ethylene vinyl acetate (EVA) or polyvinyl chloride (PVC) may also be used and can be moulded by injection or blow moulding. The body (5) has a wall thickness of between 1 mm and 3 mm while the ends (7, 9) have a thickness about double that of the body (5). A course, buttress thread (19) is provided in the outer surface of the tube (3) at each end (11, 13) and that thread receives a complementary thread on the inner surface of each closure (7, 9). A relatively hard plastics material which does not easily deform is used for the closures (7, 9). In this embodiment nylon 6 is used. The closures (7, 9) also have a robust configuration, with an end wall (21, 23) of each being about 3 mm to 5 mm thick. Also, an integrally moulded, reinforcing web structure (25, 27) is provided over the end wall (21, 23) opposite the threaded end, as best illustrated in FIGS. 5A and 5B.

O-rings (29) are provided on the outer surface of the tube (3) at each end (11, 13) to assist in providing a water impervious seal between the inner surface of the closures (7, 9) and the tube (3).

The bands (15) are made of silicon and are 15 mm to 40 mm wide and about 2 mm to 5 mm thick. PVC could also be used for the bands.

The cartridge (1) is filled with a gas producing substance (30), in this embodiment a propellant, such as nitrocellulose, ammonium nitrate or a mixture thereof. An initiator (32) is provided internally of the tube (3) and includes an elongate nozzle (34) which is a press fit at one end (36) within a socket (38) in the closure (7) to extend axially therefrom. The nozzle (34) is filled with an easily combustible material, in this embodiment also a propellant, and closed at each end (36, 37). Closing is achieved using a frangible membrane (40) heat sealed over the end (36) that is a press fit in the associated closure (9) while a hingedly secured lid (42) provides a snap fit over the free end (37) of the nozzle (34).

Figure 7:
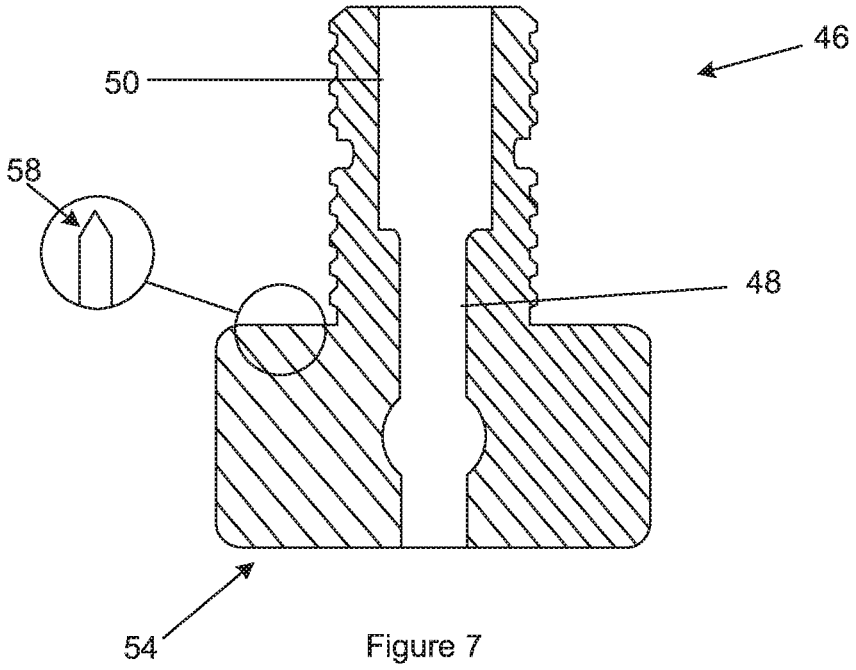
FIG. 7 is a longitudinal section of a spigot of the cartridge illustrated in FIG. 1.
Figure 8:
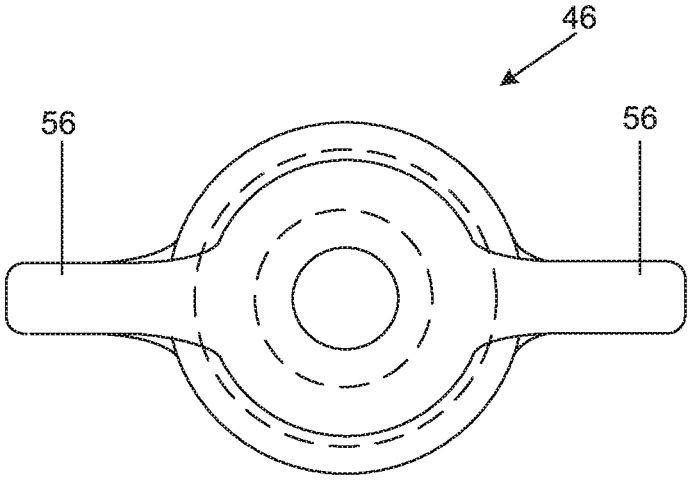
FIG. 8 is an end view of the spigot illustrated in FIG. 7.

An internally screw threaded passage (44) extends through the end wall (21) and web structure (25) (see FIG. 5A) into the socket (38) and receives a complementarily threaded spigot (46) having a central bore (48) therethrough in which is secured an electrically operated fuse head (50) in a radially outwardly stepped end section. The spigot (46) holds the fuse head (50) against the membrane (40) with the operating cable (52) extending from the free end (54) thereof. A pair of wings (56) is provided at the free end (54) of the spigot (46) to facilitate its insertion into the socket (38), as best illustrated in FIG. 8. Also, the spigot (46) and end wall (21) may be provided with complementary formations (57, 58) which prevent removal of the spigot (46) once screwed into the socket (38), as best illustrated in FIGS. 5A and 7.

Figure 9:
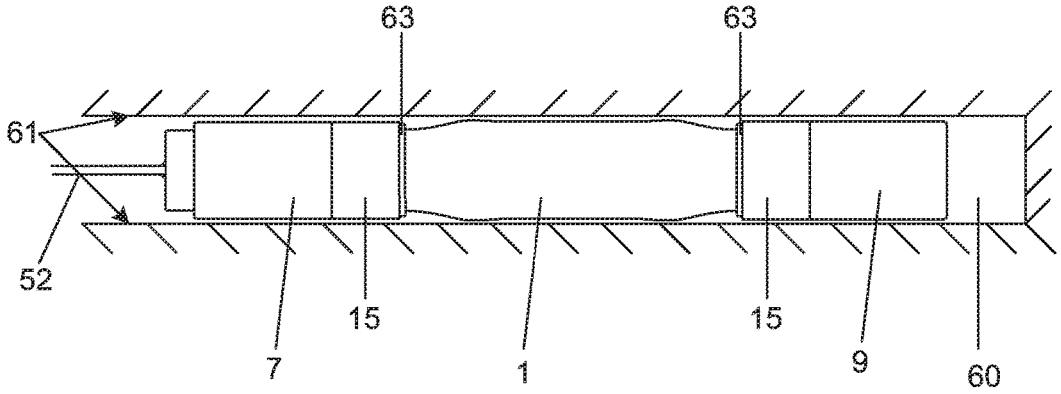
FIG. 9 is a side elevation showing the cartridge of FIGS. 1 to 3 in use in a borehole.

As shown in FIG. 9, in use, the cartridge (1) is inserted into a borehole (60) with the operating cable (52) extending from the borehole (60). The diameter of the cartridge is selected to be a few millimeters less than that of the borehole, typically in the order of 2 mm to 10 mm. No stemming is required, instead, the cartridge (1) is simply initiated after insertion into the borehole (60) and personnel have moved a safe distance away, usually about 20 m or so.

Operation of the fuse head (50) causes combustion of the material in the nozzle (34) which produces a jet-like flame and initiates the propellant (30) in the tube (3). This results in the rapid production of a large volume of gas which initially causes the body (5) of the tube (3) to expand outwardly until it abuts the side wall (61) of the borehole (60) about its circumference and further expansion is prevented. As the ends (11, 13) of the tube (3) are thicker than the central body (5) and are further secured within the closures (7, 9) they provide greater resistance to expansion than the central body (5). The adjacent sections over which the bands (15) extend only start expanding after the body has expanded to the circumference of the borehole (60). However, once this occurs, the silicon bands (15) are forced into intimate contact with the side wall (61) of the borehole (60) about its circumference where they provide an effective seal and a relatively high degree of resistance to axial movement within the borehole (60).

The configuration of the tube (3), bands and closures (7, 9) is such that the internal pressure in the tube (3) caused by initiation of the propellant (30) results in outward deformation of the body and both bands and subsequent rupture of the body (5) prior to the closures (7, 9) being dislodged from the tube (3). Thus, the closures (7, 9) remain secured to the tube (3) at pressures greater than about 10 MPa, and preferably up to about 40 MPa. This is due to the construction of the closures (7, 9), the thicker tube walls at the ends (11, 13) and the robust thread.

In consequence, the gas becomes trapped between the ends (11, 13) of the tube (3) by the closures (7, 9) and banded sections which fill the circumference of the borehole (60) and resist outward displacement, effectively stemming the borehole (60). The result is that the rock in which the borehole (60) extends fractures under pressure from the gas.

The cartridge has been found to be highly effective in breaking rock and other hard material. It has the advantages of being robust and lacking in moving parts. As stemming occurs at each end of the cartridge it can be used in boreholes which extend through a structure, for example a wall of a building. The cartridge is water proof to about 5 m and can easily be made to withstand deeper depths.

Figure 4:
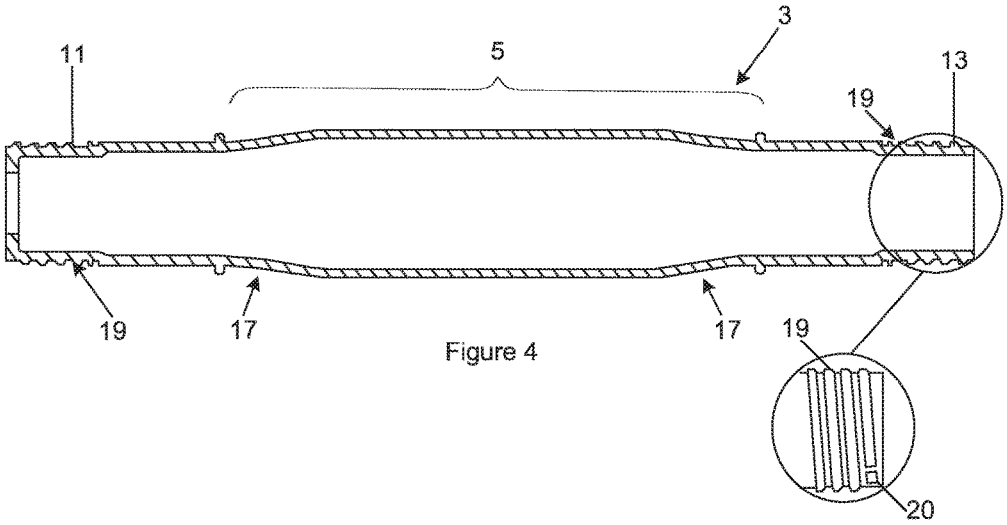
FIG. 4 is a longitudinal section of the elongate tube of the cartridge illustrated in FIG. 2.

It will be appreciated that many other embodiments of cartridge exist which fall within the scope of the invention, particularly regarding the shape and configuration thereof and the materials used. For example, a circumferential rib (63) can be provided about the tube (3) adjacent each band to provide further resistance to expansion if desired. Also, the closures and tube can be provided with cooperating detents (20), as best illustrated in FIG. 4, or inclined teeth, which prevent the closures from being removed once properly secured in place.

Figure 3A:
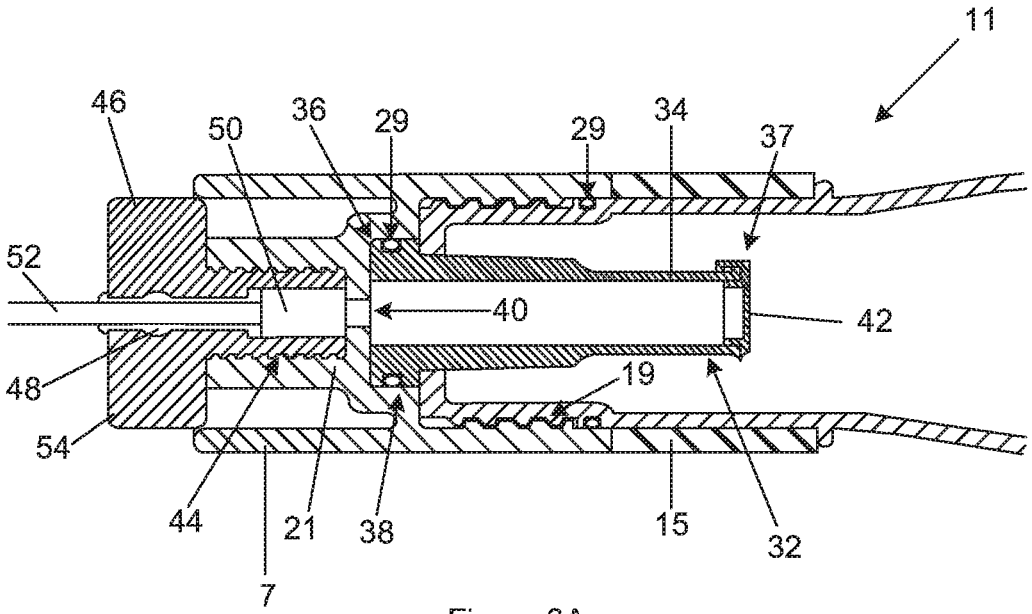
FIGS. 3A and 3B are enlarged longitudinal sections of the ends, bands and closures of the cartridge illustrated in FIG. 2.
Figure 3B:
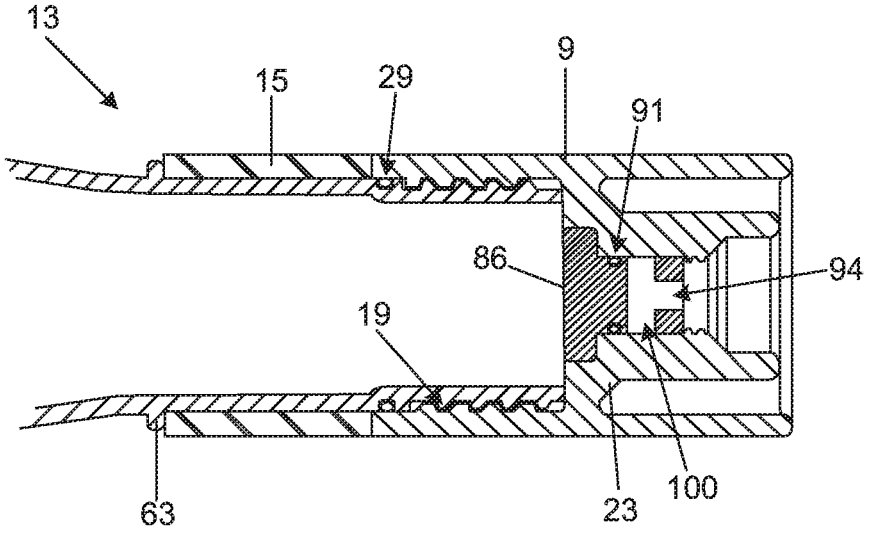
Figure 6A:
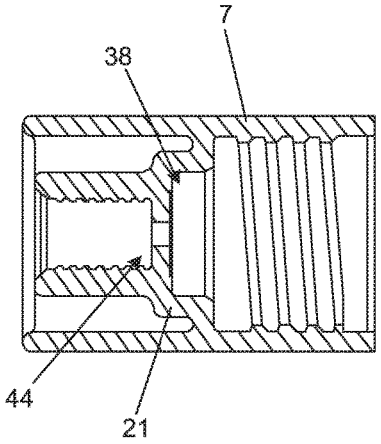
FIGS. 6A and 6B are longitudinal sections of the closures at each of the two ends of the cartridge illustrated in FIGS. 1 to 3.
Figure 6B:
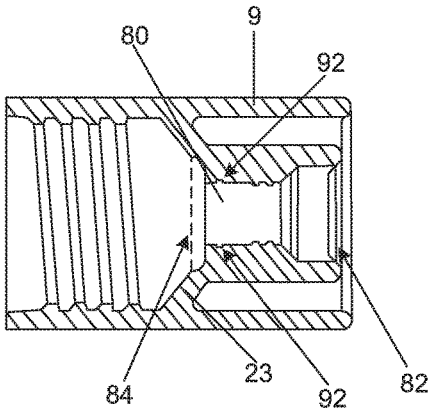
Figure 10:
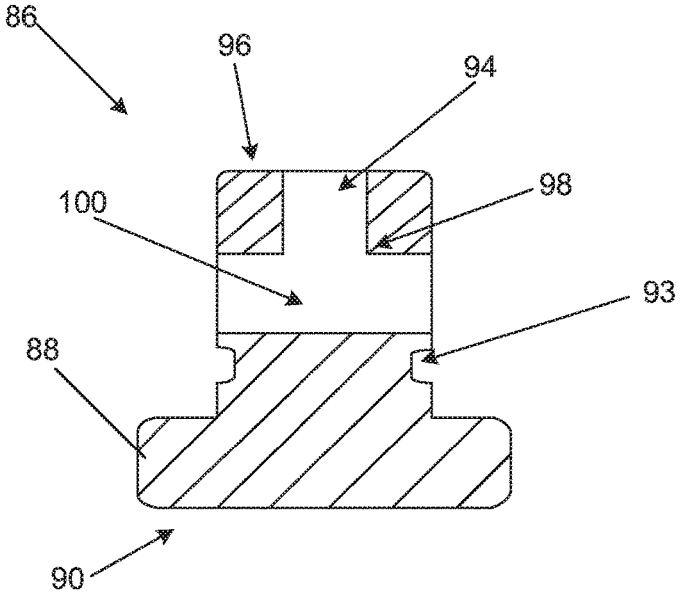
FIG. 10 is a longitudinal section of a plug of the cartridge illustrated in FIGS. 1 to 3.

Furthermore, provision can be made for securing one or more booster cartridges to the cartridge. As shown in FIGS. 3B and 6B, the closure (9) opposite that carrying the nozzle (34) can have a central passage (80) therethrough and internally threaded from the external end (82) to adjacent the internal end (84). A plug (86), illustrated in FIG. 10, provides a sliding fit within the internal end (84) of the central passage (80) and has a radial flange (88) at one end (90) which acts as a stop to prevent further movement into the passage (80). An O-ring (91) locates in a pair of complementary grooves (92, 93) on the plug (86) and in the wall of the passage (80) which align with the plug (86) fully inserted into the passage (80). The O-ring (91) provides resistance to movement of the plug (86) into the passage (80) and so keeps the plug (86) in position.

A central bore (94) extends from the free end (96) of the plug (86) partway along its length and is intersected at its end (98) by a further bore (100) extending diametrically through the plug (86). With the plug (86) fully inserted in the passage (80) the bore (100) is enclosed.

Figure 11:
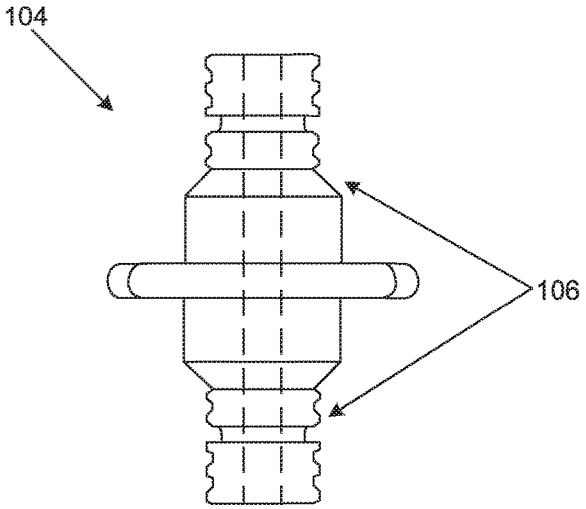
FIG. 11 is a side elevation of a connector for connecting a booster cartridge to the cartridge illustrated in FIGS. 1 to 3.

A connector (104), illustrated in FIG. 11, is provided which is simply a length of tubing which is screw threaded at both ends (106), and each end of which is a screw fit within the threaded part of the passage (80). When the connector (104) is fully screwed into the passage (80) it displaces the plug (86) axially against the resistance provided by the O-ring (91) to the extent that the bore (100) becomes exposed to the interior of the cartridge (1).

Figure 12:
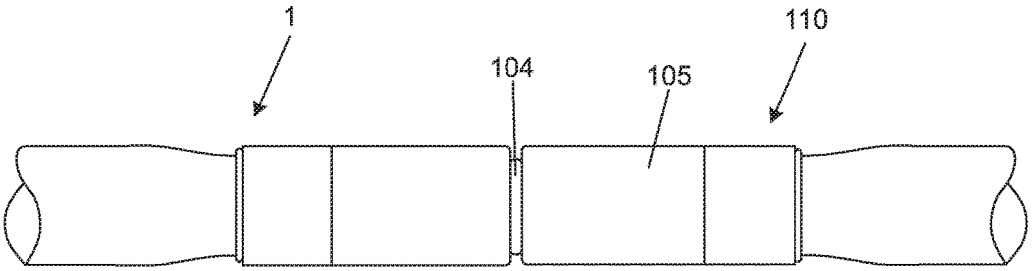
FIG. 12 is a side elevation of one end of a cartridge connected to one end of a booster cartridge by means of the connector illustrated in FIG. 11.

The opposite end of the connector (104) is connected to a closure (105) on a booster cartridge (110) having an identical configuration to the cartridge (1), as illustrated in FIG. 12.

Initiation of the propellant in the cartridge (1) causes a flash to run through the exposed bore (100) in the plug (86) and into the bore (94), through the connector (104) and into the booster cartridge (110) through the same plug arrangement. This causes initiation of the booster cartridge (110).

The connector (104) is dimensioned to permit the adjacent ends of the cartridge (1) and booster cartridge (110) to abut and so provide a fairly rigid structure. Of course, a number of booster cartridges can be so connected in series and in which case each closure of the booster cartridges will have the same configuration as the closure illustrated in FIG. 6B to permit insertion of the connector (104).

As the cartridge does not have any moving parts, its reliability upon ignition is significantly increased over prior art cartridges as there are no parts that need to align to enable the cartridge to function. Further, as the cartridge is symmetrical, it does not act like a rocket once ignited. This makes the cartridge extremely safe to handle and to use.

It will further be appreciated that the cartridge is extremely safe to transport as the cartridge and fuse head can be transported separately from each other and in so doing prevent accidental ignition of the cartridge.

Figure 13:
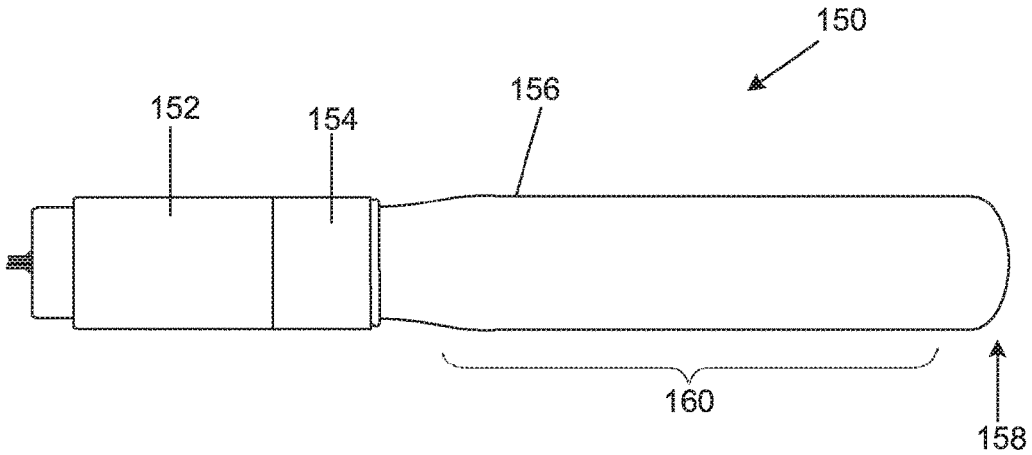
FIG. 13 is a side elevation of a second embodiment of cartridge in accordance with the invention, in which the cartridge has a closure and band at only one end; and, FIG. 14 is a side elevation of a third embodiment of a cartridge in accordance with the invention, in which the cartridge has a closure at one end with an aperture provided in the tube that is covered by the band of elastically deformable material.

It will of course be appreciated that in an alternative embodiment of the invention, the cartridge (150) may only have one closure (152) and one band of elastically deformable material (154) adjacent the closure (152). Such an embodiment is illustrated in FIG. 13. The cartridge (150) of this embodiment is substantially similar to the cartridge illustrated in FIGS. 1 to 10, except that instead of having two closures, the cartridge (150) of this embodiment only has one closure (152). Furthermore, the tube (156) has a domed closed end (158) opposite the closure (152) so as to ensure that the body (160) of the tube (156) and the single band (154) deform radially outwardly, thereby stemming a blind borehole, prior to dislodgement of the closure (152) or rupture of the tube (156) or closed end (158).

Figure 14:
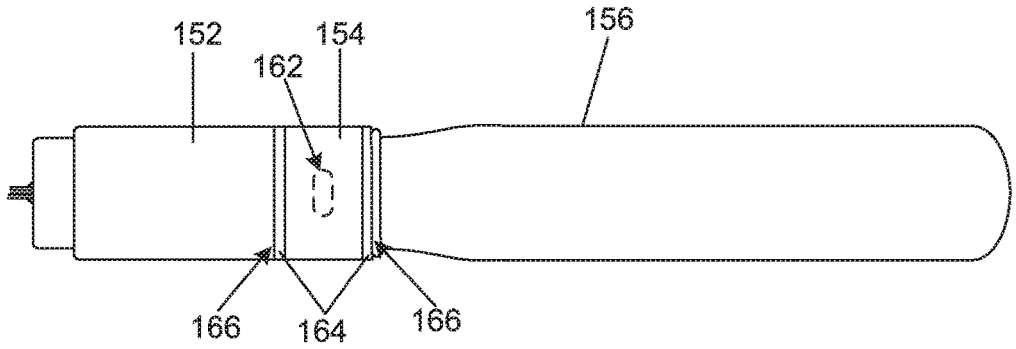

In addition and as illustrated in FIG. 14, in order to assist with the stemming action, it is envisaged that the cartridge (150) may include a line of weakness or an aperture (162) in the tube (156) adjacent the closure (152) and which is covered by the band of elastically deformable material (154). In this case, the band (154) of elastically deformable material is preferably tightly secured to the tube (156) by means of resiliently deformable straps (164) secured about the band (154) adjacent each edge (166) thereof. The line of weakness or aperture (162) may permit gas produced within the cartridge (150) to escape, thereby accelerating the rate of deformation of the elastically deformable band (154) and hence accelerating the rate at which stemming takes places. It will be appreciated that securing of the edges (166) of the elastically deformable band (154) may of course also be achieved by means of an adhesive or the like, so as to ensure that the gas does not simply escape without deforming the band (154).

The invention claimed is:

1. A cartridge which includes an elongate tube having a central body closed at each end and containing a gas producing substance, wherein the elongate tube is made of a plastics material capable of outward deformation, the cartridge further including two discrete bands of an elastically deformable material, each band being towards a different end thereof and the bands not extending along an entire central zone of the elongate tube, configured so that, in use, internal pressure in the elongate tube caused by initiation of the gas producing substance results in outward deformation of the central body and the bands being effectively urged into sealing contact with a surrounding wall of a borehole to stem the borehole prior to any subsequent rupture of the elongate tube or dislodgement of any closure from the elongate tube.

2. A cartridge as claimed in claim 1 in which one or both ends of the elongate tube are provided with a separately manufactured closure.

3. A cartridge as claimed in claim 1, wherein the elongate tube has an inwardly tapered shoulder and the central body, the bands, and any closure have substantially the same diameter.

4. A cartridge as claimed in claim 1, wherein the bands are about 15 mm to 40 mm wide and about 2 mm to 5 mm thick.

5. A cartridge as claimed in claim 1, wherein the central body of the elongate tube has a wall thickness of about 1 mm and 3 mm and the ends of the elongate tube have a thickness about double that of the central body.

6. A cartridge as claimed in claim 2, wherein the end wall of the closure is about 3 mm to 5 mm thick.

7. A cartridge as claimed in claim 2, wherein the closure is configured to remain secured to the elongate tube at pressures greater than 10 MPa.

8. A cartridge as claimed in claim 7, wherein the closure is configured to remain secured to the elongate tube at pressures up to about 40 MPa.

9. A cartridge as claimed in claim 2, wherein the closure is fastened to the elongate tube by means of a screw thread arrangement and the elongate tube includes a detent so as to prevent removal of the closure from the elongate tube once secured thereto.

10. A cartridge as claimed in claim 2, wherein an initiator is held within the cartridge, the initiator including an elongate nozzle filled with an easily combustible material, and which is in a press fit to the closure so as to extend axially therefrom and wherein the free end of the nozzle is closed by a hingedly secured lid and the other end is closed by a frangible membrane.

11. A cartridge as claimed in claim 1, wherein a fuse head is external to the cartridge.

12. A cartridge as claimed in claim 11, wherein the fuse head is held within a spigot which is attachable to the cartridge by means of a screw thread arrangement and wherein an operating cable extends externally from the spigot.

13. A cartridge as claimed in claim 2 in which the cartridge has a closure at each end with one of the closures being configured to enable a booster cartridge to be attached thereto, wherein the closure includes an internal plug that is dislodged automatically when a connector is attached thereto.

* * * * *